US008172373B2

(12) United States Patent
Oshima et al.

(10) Patent No.: US 8,172,373 B2
(45) Date of Patent: May 8, 2012

(54) FLUID EJECTION DEVICE

(75) Inventors: Atsushi Oshima, Shiojiri (JP); Shinichi Miyazaki, Suwa (JP); Kunio Tabata, Shiojiri (JP); Nobuaki Azami, Matsumoto (JP); Hiroyuki Yoshino, Matsumoto (JP); Noritaka Ide, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 263 days.

(21) Appl. No.: 12/724,816

(22) Filed: Mar. 16, 2010

(65) Prior Publication Data

US 2010/0238210 A1 Sep. 23, 2010

(30) Foreign Application Priority Data

Mar. 23, 2009 (JP) ..... 2009-069603

(51) Int. Cl.
*B41J 2/045* (2006.01)

(52) U.S. Cl. ..... 347/68; 347/9

(58) Field of Classification Search ..... 347/9, 10, 347/68

See application file for complete search history.

(56) References Cited

U.S. PATENT DOCUMENTS

| | | | | |
|---|---|---|---|---|
| 4,639,735 | A * | 1/1987 | Yamamoto et al. | 347/68 |
| 6,502,914 | B2 * | 1/2003 | Hosono et al. | 347/11 |
| 7,049,756 | B2 | 5/2006 | Aiba et al. | |

FOREIGN PATENT DOCUMENTS

| | | |
|---|---|---|
| JP | 2003-285441 | 10/2003 |
| JP | 2004-306395 | 4/2004 |

* cited by examiner

*Primary Examiner* — Juanita D Jackson
(74) *Attorney, Agent, or Firm* — Maschoff Gilmore & Israelsen

(57) ABSTRACT

A fluid ejection device including, a drive element capable of storing a charge depending on a voltage applied to the drive element, a first capacitor, a second capacitor, and a power recovery module that recovers power from the drive element by connecting the first capacitor and the second capacitor to the drive element in series, wherein the power recovery module switches the first capacitor out of the in-series connection to further recover power from the drive element.

5 Claims, 9 Drawing Sheets

FLUID EJECTION DEVICE

This application claims priority to Japanese Patent Application No. 2009-069603, filed Mar. 23, 2009, the entirety of which is hereby incorporated by reference.

BACKGROUND

1. Technical Field

The present invention relates to a technology which ejects a fluid from an ejection head.

2. Related Art

Ink jet printers today are widely used to output desired images by ejecting ink onto printing media to produce high quality printed image. The technology of ink jet printing can also be applied in various kinds of manufacturing processes of precision parts such as electrodes, sensors or biochips, by ejecting appropriately prepared fluid (fluid containing dispersed microparticles or semifluid such as gel, for example) onto substrates.

Specially designed ejection head provided with microscopic ejection ports is used to realize such accuracy in ejecting correct quantity of fluid onto a correct position. Drive elements (for example, piezoelectric elements) connected to the ejection ports of the ejection head operate in accordance with a voltage applied. Hence, appropriately controlling the voltage applied to the drive elements enables the control of the quantity of fluid being ejected.

When using piezoelectric elements as the drive elements, because they are capacitive loads, power supplied to the drive elements to raise the applied voltage is stored in the drive elements. If the power stored in the drive elements is recovered to capacitors as the voltage applied to the drive elements is lowered to be reused again for raising the voltage applied to the drive elements, it highly contributes to improving power efficiency. Although, if the voltage of the capacitors is significantly low with respect to the terminal voltage of the drive elements, a large current flows out from the drive elements to the capacitors once the recovery of the power is attempted, resulting in large power consumption. Yet, if the terminal voltage of the drive elements is too close to the voltage of the capacitors, not much of power in the drive elements can be recovered. JP-A-2003-285441 discloses capacitors with differing voltages connectable to the drive elements, in which the capacitors with higher voltages are connected to the drive elements until recovering of the power becomes difficult, then the capacitors are switched to those with lower voltages. It enables much of power to be recovered while avoiding the current flow.

However, JP-A-2003-285441 requires capacitors with differing voltages, corresponding power sources to charge the capacitors at different voltages, and much space to fit them all inside the device.

SUMMARY

An advantage of some aspects of the invention is to provide a technology which can efficiently recover power without unnecessarily increasing the size of a device.

A fluid ejection device of one aspect of the invention is a fluid ejection device including, a drive element that stores or releases a charge depending on a voltage applied to the drive element, a first capacitor, a second capacitor, and a power recovery module that connects the first capacitor and the second capacitor to the drive element in series to decrease the voltage applied to the drive element, wherein the power recovery module switches the first capacitor or the second capacitor out of the in-series connection to further decrease the voltage applied to the drive element.

This fluid ejection device of the one aspect of the invention includes a plurality of capacitors connectable to the drive element in series to recover the charge accumulated in the drive element. When the voltage of the drive element lowers as the charge is recovered to the capacitors, the number of capacitors connected in series is reduced.

Connecting the capacitors in series produces a summed voltage of all the capacitors connected in series, enabling the total voltage of the capacitors to be close to the voltage of the drive element. Bringing the total voltage of the capacitors close to the voltage of the drive element suppresses an excessive current flow from the drive element when connected to the capacitors, and contributes to an efficient recovery of the charge in the capacitors while saving power. When the voltage of the drive element falls as the recovery of the charge proceeds to the level where it is difficult for the drive element to further release the charge, a number of the capacitors connected in series may be reduced to decrease the total voltage of the capacitors. Reducing the number of the capacitors connected in series lowers the total voltage of the capacitors, enabling further charge recovery from the drive element. Neither capacitors with differing voltages or corresponding power sources for charging those capacitors at differing voltages are necessary. Controlling the number of the capacitors connected in series realizes an efficient power recovery system in the device with simple configuration.

In the fluid ejection device of the one aspect of the invention, reducing the number of the capacitors connected in series may also be done by switching a number of the capacitors from in-series connections to in-parallel connections.

Recovering the charge by switching the connections of the capacitors may cause variance in the amount of electrical charge recovered from one capacitor to another. The variance may be caused, for example, by each capacitor being connected to the drive element for different periods of time. Switching a capacitor from in-series to in-parallel connection enables the recovered charge to be shared among the capacitors connected in parallel, so as to eliminate variances in the amount of the charge recovered.

In the one aspect of the invention, reducing a number of the capacitors connected in series to the drive element enables the charge to be efficiently recovered while keeping the size of the device down. The charge recovered may be reused to drive the drive element, improving energy efficiency. The invention may be applicable not only to the fluid ejection device but also to other devices that employ a drive element or any driving circuit that drives a drive element. The invention can be understood as being directed to a drive circuit including, a drive element that stores or releases a charge depending on a voltage applied to the drive element, a first capacitor, a second capacitor, and a power recovery module that connects the first capacitor and the second capacitor to the drive element in series when the voltage applied to the drive element is lowered, wherein the power recovery module switches the first capacitor or the second capacitor off when the voltage applied to the drive element is further lowered.

In the drive circuit of the one aspect of the invention includes a plurality of capacitors connectable to the drive element in series to recover the charge accumulated in the drive element. When the voltage of the drive element lowers as the charge is recovered to the capacitors, the number of capacitors connected in series is reduced.

This way the total voltage of the capacitors and the voltage of the drive element or a piezoelectric element are kept close, so to suppress an electrical current flow. By reducing the number of the capacitors connected in series, the charge accumulated in the drive element can be efficiently recovered. Neither capacitors with differing voltages or corresponding power sources for charging those capacitors at differing voltages are necessary. Controlling the number of the capacitors connected in series realizes a device that has such driving circuit in it without complicating its structure.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, further descriptions will be provided for embodiments of the invention in the following order.

Figure 1:
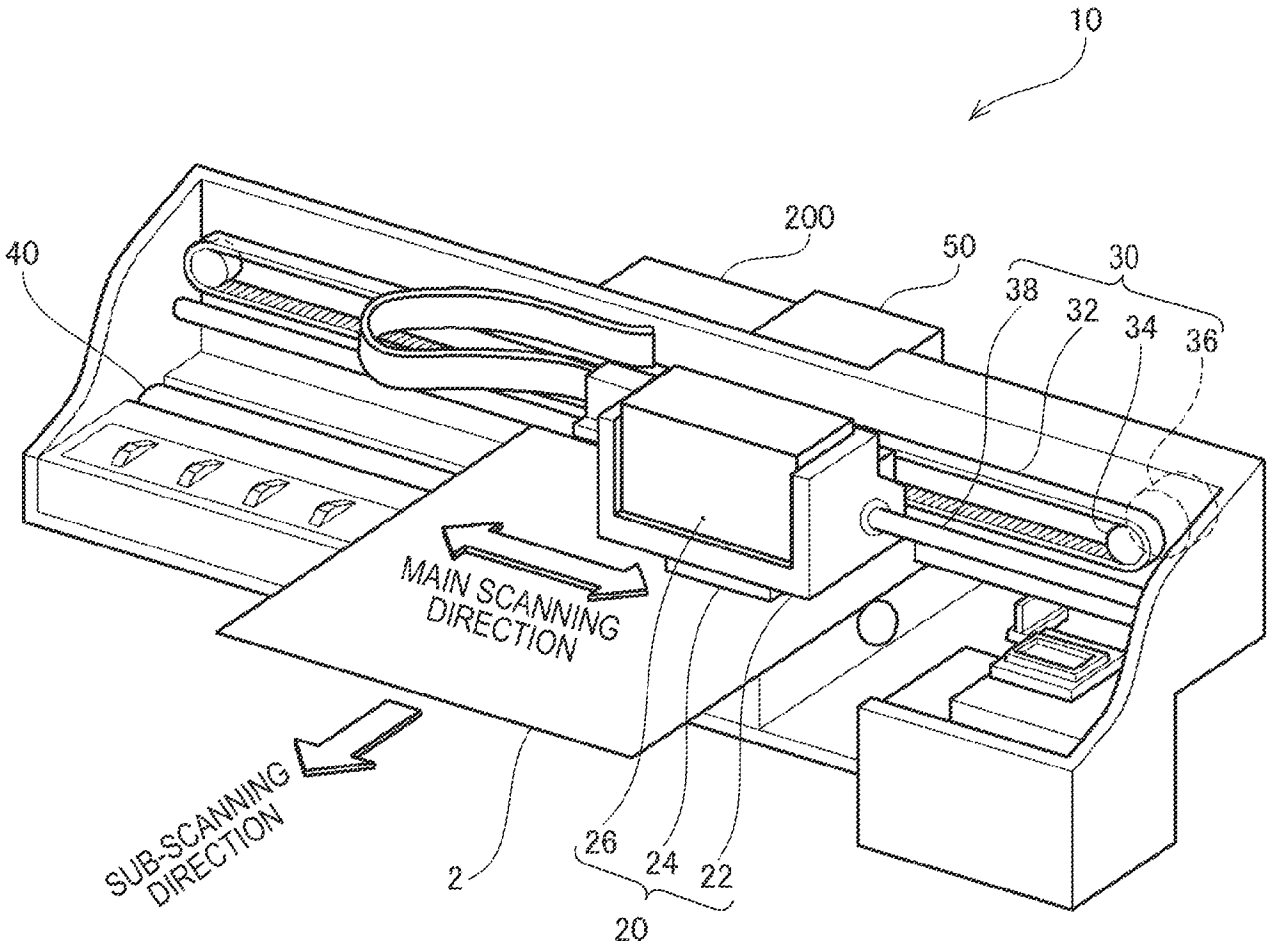
FIG. 1 is an illustration of an outline configuration of a fluid ejection device of an embodiment using an ink jet printer as an example.

A. Device Configuration
B. Piezoelectric Element Drive Circuit of First Embodiment
C. Power Recovery Module of First Embodiment
D. Piezoelectric Element Drive Circuit of Second Embodiment
E. Modified Embodiments
  E-1. First Modified Embodiment
  E-2. Second Modified Embodiment A. Device Configuration FIG. 1 is an illustration showing an outline configuration of a fluid ejection device of an embodiment using an ink jet printer. An ink jet cartridge 10 is configured of a carriage which forms ink dots on a printing medium 2 while reciprocating in a main scanning direction, a drive mechanism 30 which reciprocates the carriage 20, a platen roller 40 for carrying out a feed of the printing medium 2, and the like. An ink cartridge 26 containing ink, a carriage case 22 in which the ink cartridge 26 is loaded, an ejection head 24, mounted on a bottom side (the side facing the printing medium 2) of the carriage case 22, which ejects ink, and the like, are provided in the carriage 20. By guiding the ink inside the ink cartridge 26 to the ejection head 24, it is possible to eject an accurate amount of ink from the ejection head 24 toward the printing medium 2.

The drive mechanism 30 which reciprocates the carriage 20 is configured of a guide rail 38 extending in the main scanning direction, a timing belt 32, on an inner side of which a plurality of teeth are formed, a drive pulley 34 which meshes with the teeth of the timing belt 32, a step motor 36 for driving the drive pulley 34, and the like. One portion of the timing belt 32 being fixed to the carriage case 22, on driving the timing belt 32, it is possible to cause the carriage case 22 to move with high precision along the guide rail 38.

The platen roller 40 is driven by a drive motor and gear mechanism, both not shown, and feeds the printing medium 2 in predetermined increments in a sub-scanning direction. Each of these mechanisms is controlled by a printer control circuit 50 mounted in the ink jet printer 10. The ink jet printer 10, using each of these mechanisms, drives the ejection head 24 while feeding the printing medium 2, ejects the ink, and prints an image on the printing medium 2.

Figure 2:
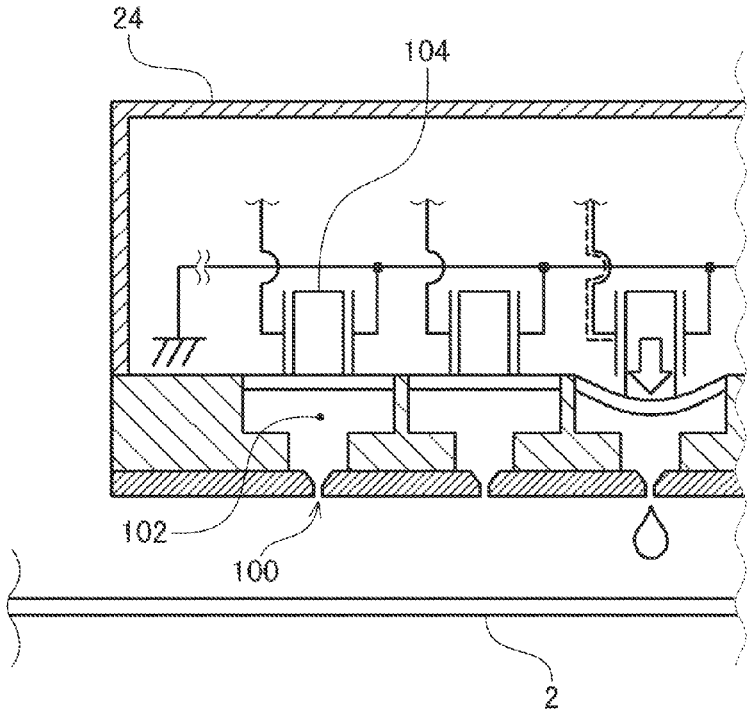
FIG. 2 is an illustration of internal mechanism of an ejection head 24.

FIG. 2 is an illustration showing in detail an internal mechanism of the ejection head 24. A plurality of ejection ports 100 being provided in the bottom of the ejection head 24, an ink droplet can be ejected from each of the ejection ports 100. Each ejection port 100 being individually connected to an ink chamber 102, the ink chamber 102 is filled with ink supplied from the ink cartridge 26. A piezoelectric element 104 is provided on each ink chamber 102. When a voltage is applied to the piezoelectric element 104, the piezoelectric element deforms and pressurizes the ink chamber 102 to eject an ink droplet from the ejection port 100. The amount of deformation of the piezoelectric element 104 changes in accordance with the voltage applied. Appropriately controlling the voltage applied to the piezoelectric element 104 makes the force pressed upon the ink chamber 102 or a timing of the pressing force controllable for changing the size of the ink droplet being ejected. The inkjet printer 10 applies a voltage waveform such as the following to the piezoelectric element 104.

Figure 3:
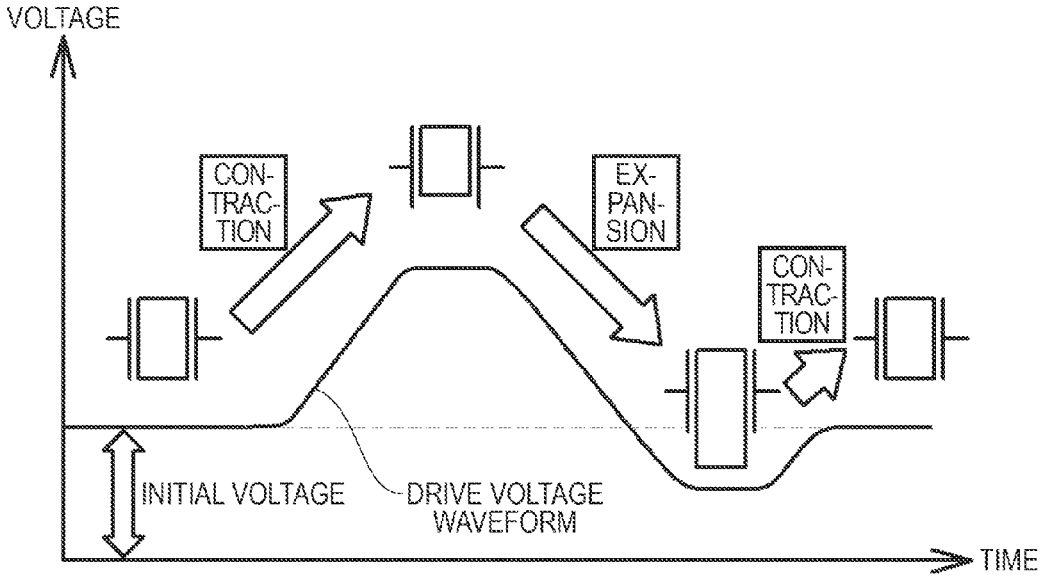
FIG. 3 is an illustration exemplifying a voltage waveform (a drive voltage waveform) applied to a piezoelectric element.

FIG. 3 is an illustration exemplifying a drive voltage waveform applied to the piezoelectric element. The drive voltage waveform is a trapezoidal waveform in which the voltage rises as time advances, subsequently falls, and returns to the original voltage. FIG. 3 illustrates the piezoelectric element expanding and contracting in accordance with such drive voltage waveform. The piezoelectric element gradually contracts in response to a rise in the drive voltage waveform voltage. At this time, as the ink chamber expands as though it is pulled by the piezoelectric element, the ink can be supplied into the ink chamber from the ink cartridge. When the voltage falls after reaching the highest peak, the piezoelectric element compresses the ink chamber by expanding, which causes ink to be ejected from the ejection port. At this time, the voltage of the drive voltage waveform falls to a point lower than the original voltage (a value indicated by "Initial voltage" in FIG. 3) so as to cause the piezoelectric element expand more than it did initially to sufficiently push out the ink. The drive voltage waveform then returns to the initial voltage and so does the piezoelectric element in preparation for the next operation.

The ink jet printer 10 ejects an ink droplet by applying a voltage waveform to the piezoelectric element provided in the ejection head 24. The piezoelectric element is a capacitive load, which holds power in the piezoelectric element when the voltage applied is raised, or releases power from the piezoelectric element when the voltage applied falls. Collecting the released power for a reuse in raising the voltage again contributes in energy saving and improving power efficiency. The ink jet printer 10 of the embodiment drives the piezoelectric element using the following circuit configuration to efficiently collect and reuse the power supplied to the piezoelectric element.

Figure 4:
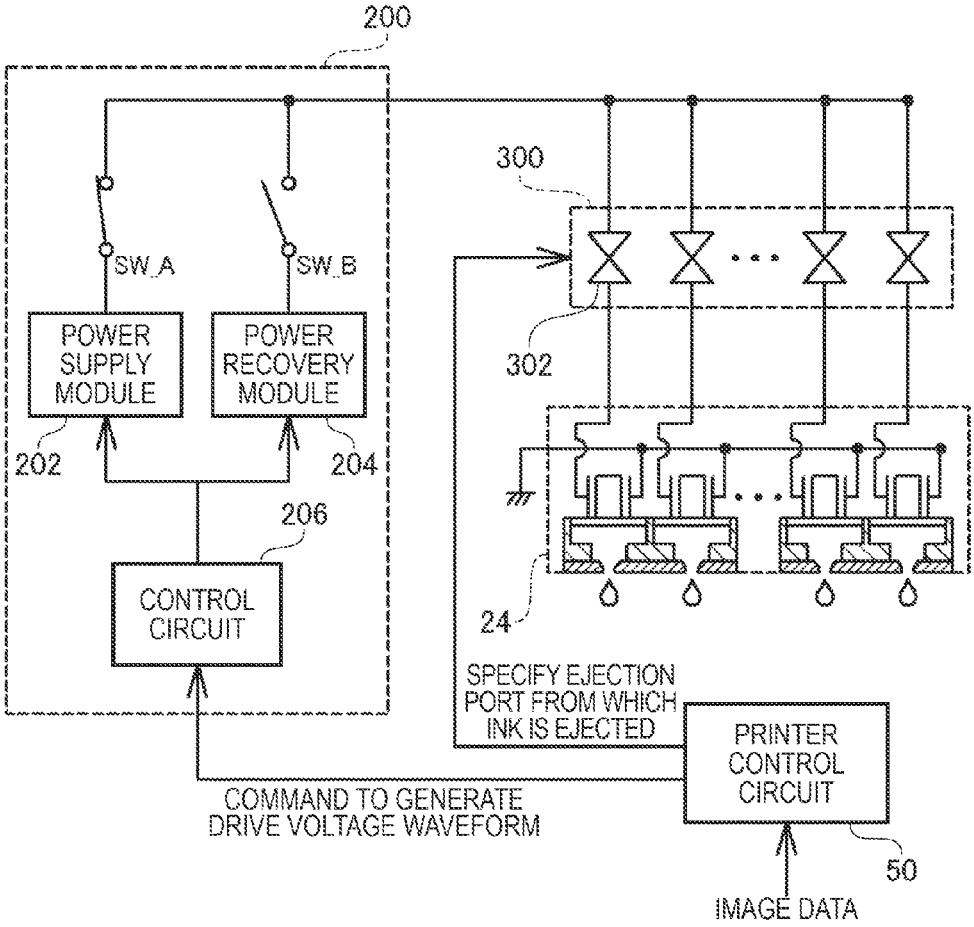
FIG. 4 is an illustration of a piezoelectric element drive circuit, and its peripheral circuit configuration.

B. Piezoelectric Element Drive Circuit of First Embodiment:

FIG. 4 is an illustration showing a piezoelectric element drive circuit of the embodiment, and its peripheral circuit configuration. The piezoelectric element drive circuit 200 is configured of a power supply module 202, a power recovery module 204, a control circuit 206 which controls the power supply module 202 and power recovery module 204. The power supply module 202, being a power source circuit for supplying power to the piezoelectric element, generates power to drive the piezoelectric element in accordance with a command from the control circuit 206. The power generated by the power supply module 202 is supplied to a gate unit 300 via a switch SW_A.

The gate unit 300 is a circuit unit in which gate elements 302 are connected in parallel. The piezoelectric elements 104 are connected subsequently to the gate elements 302. Each of the gate elements 302 can be individually controlled to be connected or disconnected. By connecting only those gate elements 302 corresponding to the ejection ports that are about to eject ink droplets, only the piezoelectric elements 104 corresponding to the gate elements 302 are supplied with power to eject ink droplets from the ejection ports.

The piezoelectric element 104 can also be connected to the power recovery module 204 via a switch SW_B. As described above, the piezoelectric element 104 is a capacitive load. The power stored in the piezoelectric element 104 is released when the voltage applied to the piezoelectric element 104 falls. In the piezoelectric element drive circuit 200 of the embodiment, the released power is recovered to the power recovery module 204 so to be reused to raise the voltage again to improve power efficiency. A detailed description will be given hereafter of an operation with which the power recovery module 204 recovers power and reuses the power.

The piezoelectric element drive circuit 200 and gate unit 300, each being connected to the printer control circuit 50, are driven in accordance with a command of the printer control circuit 50. The printer control circuit 50, using these control configurations, ejects the ink droplet in the following way. Firstly, the printer control circuit 50, based on image data to be printed, determines the ejection port from which the ink droplet is to be ejected, and the size of the ink droplet to be ejected. Also, the printer control circuit 50 determines a voltage waveform for ejecting ink droplets in accordance with the size of the ink droplets to be ejected. Then, the printer control circuit 50 sends a command to the gate unit 300 putting the gate element 302 corresponding to that ejection port in the conductive condition, and sends a command to the piezoelectric element drive circuit 200 to generate the determined voltage waveform. In response to this, the piezoelectric element drive circuit 200 operates the power supply module 202 and power recovery module 204, generating the voltage waveform, and applies the voltage to the piezoelectric element 104 of the specified ejection ports via the gate elements 302. By this means, the piezoelectric element is driven, and the ink droplets are ejected from the ejection ports.

With the piezoelectric element drive circuit 200 of the embodiment, it is possible not only to supply power with the power supply module 202, but also to recover and reuse the power with the power recovery module 204. Because of this, it is possible to increase the power efficiency, and achieve a power saving. Hereafter, a detailed description will be given of the power recovery module 204.

Figure 5:
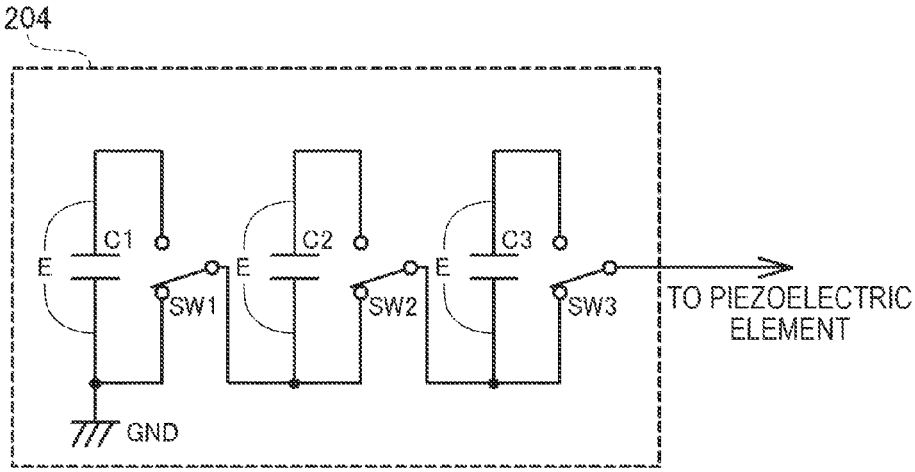
FIG. 5 is an illustration of a circuit configuration of a power recovery module.

C. Power Recovery Module of the Embodiment:

FIG. 5 is an illustration showing an internal circuit configuration of the power recovery module of the embodiment. The power recovery module 204 includes a plurality of capacitors for storing the power released from the piezoelectric element. These capacitors have been charged to a predetermined voltage (a value indicated as "E" in the illustration).

In the event that the voltage stored in the capacitors is too close to the voltage of the piezoelectric element, not much power can flow out from the piezoelectric element, as previously described, meaning that it is not possible to recover sufficient power. On the contrary, when the difference between the voltage of the piezoelectric element and the voltage stored in the capacitors is too great, a large current flows while consuming power.

Figure 6A:
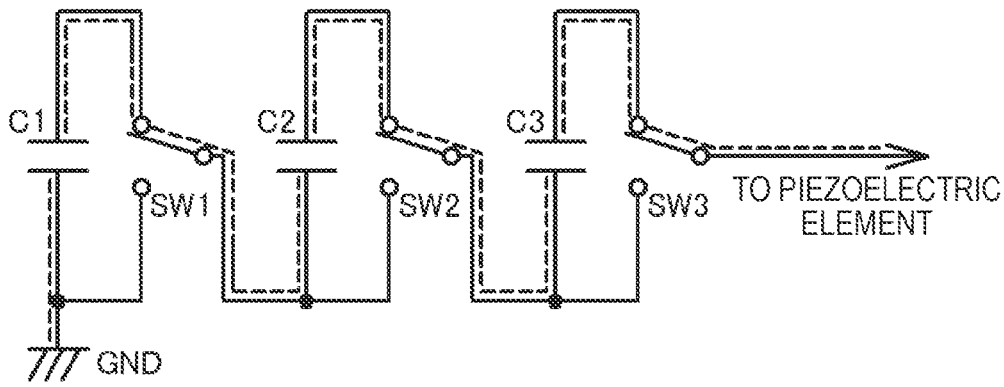
FIGS. 6A to 6C are illustrations showing how capacitors are connected in series by changing over switches of the power recovery module.
Figure 6B:
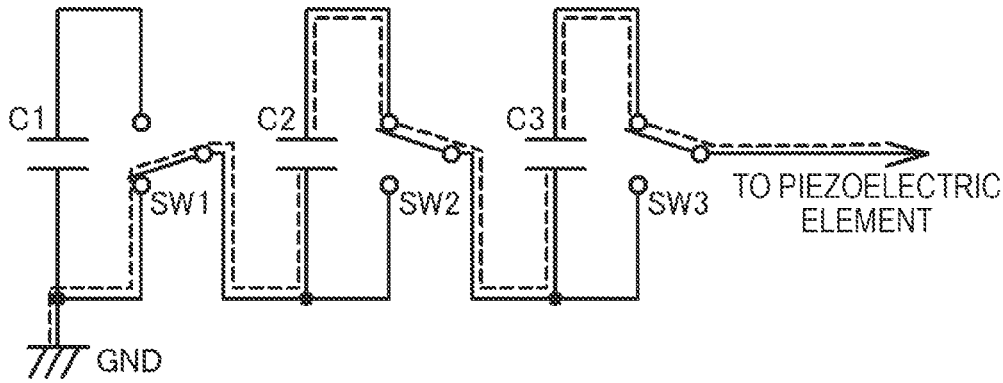
Figure 6C:
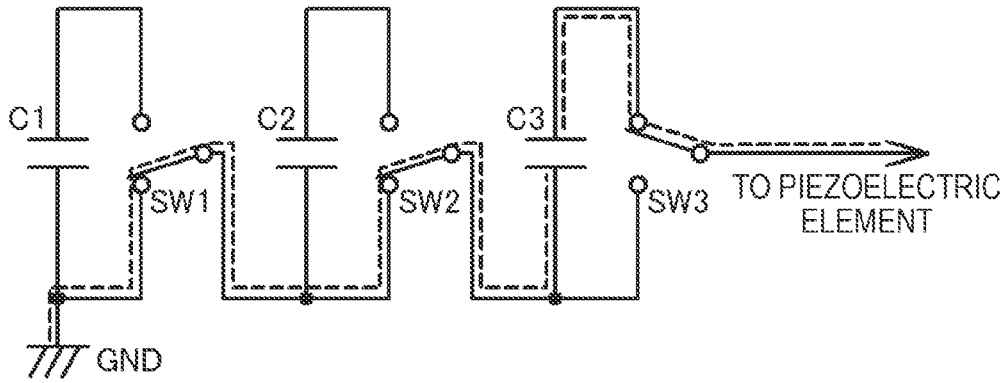
Figure 7A:
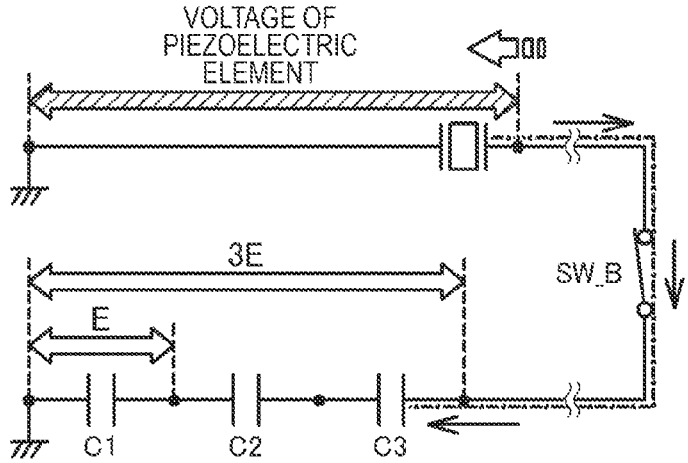
FIGS. 7A to 7C are illustrations showing how the power of the piezoelectric element is recovered by the power recovery module.
Figure 7B:
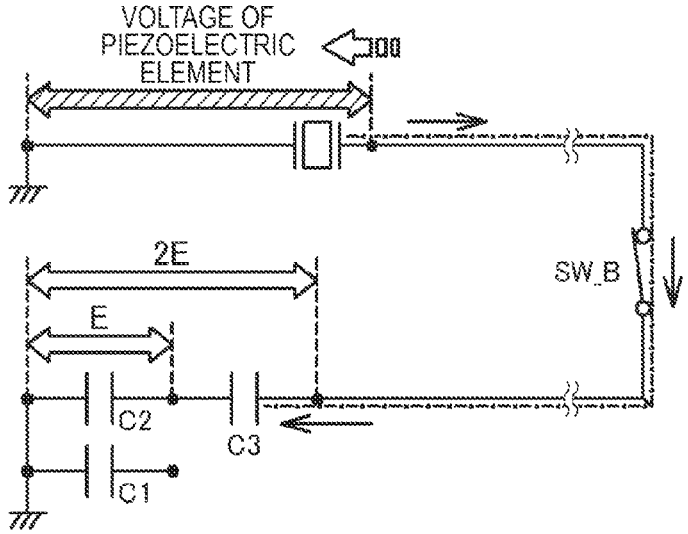
Figure 7C:
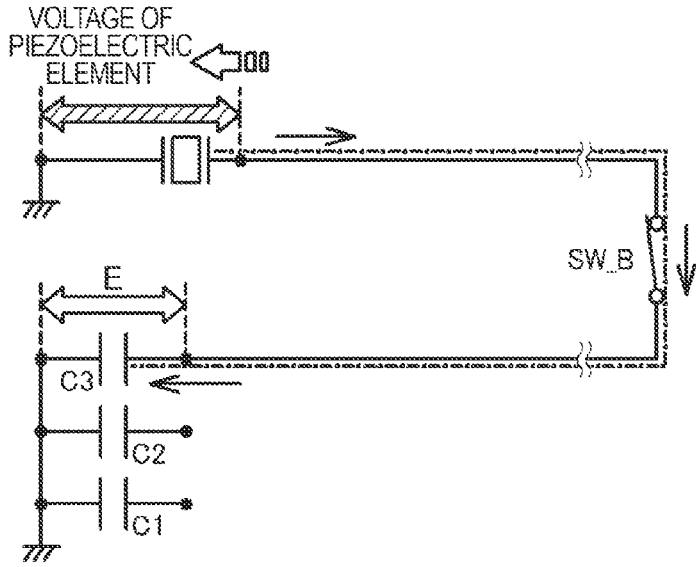

The power recovery module 204 of the embodiment includes switches SW1 to SW3 provided between each of the capacitors to control the connections of the capacitors. Switching the capacitors off or to connect them in series enables an efficient power recovery. Before further describing the operation with which the power recovery module 204 recovers the power, switching control will be briefly described hereinafter. The power recovery module 204 may have any desired number of capacitors, but the power recovery module 204 in this embodiment has three capacitors (the capacitors indicated as "C1" to "C3" in the illustration) for the sake of simplicity. FIGS. 6A to 6C are illustrations showing the capacitors are connected to the piezoelectric element in series. FIG. 6A illustrates that each of the switches SW1 to SW3 is flipped upwards to connect to the upper side. In this condition, the switch SW1 connects the upper terminal of the capacitor C1 to the lower terminal of the capacitor C2 of the illustration, connecting the capacitors C1 and C2 in series. Additionally turning the switch SW2 over to the upper side connects the upper terminal of the capacitor C2 to the lower terminal of the capacitor C3, connecting the capacitors C1, C2 and C3 in series. Additionally turning the switch SW3 over to the upper side connects all the three capacitors to the piezoelectric element in series, as indicated in the illustration by the broken line. In the power recovery module of the embodiment, only two capacitors, instead of all the three, may be connected to the piezoelectric element in series. For example, as shown in FIG. 6B, flipping the switch SW1 downward to the lower side to disconnect the capacitor C1 causes the rest of the two capacitors C2 and C3 connected in series to the piezoelectric element. Switching the switches SW1 as well as SW2 downward to the lower side, as shown in FIG. 6C, causes the capacitor C1 and capacitor C2 cut off from the connection to the piezoelectric element to connect only the capacitor C3. The power recovery module 204 of the embodiment is able to connect all of the capacitors or only some of the capacitors in series. The power recovery module 204 recovers the power of the piezoelectric element utilizing such switchable connections. FIGS. 7A to 7C are illustrations showing an aspect of the power of the piezoelectric element being recovered by the power recovery module of the embodiment. FIG. 7A illustrates the status immediately after starting the power recovery. The hatched arrow indicates the voltage of the piezoelectric element, representing the high voltage of power is stored in the piezoelectric element from being driven by the power supply module 202. As previously described, if the voltage of the piezoelectric element is too high with respect to that of the connecting capacitors, a large current flow is produced and consumes power. To avoid a large current flow, the power recovery module 204 connects the piezoelectric element to the three capacitors C1 to C3 in series. Each capacitor is charged in advance to a predetermined voltage (a value indicated as E in the illustration), and connecting the three capacitors in series produces a total voltage of 3E. The total voltage of the capacitors is brought closer to the voltage of the piezoelectric element and hence, the power consumption due to the current flow is reduced to be able to efficiently recover the power.

If the power keeps recovered from the piezoelectric element this way, the voltage of the piezoelectric element lowers along to the point where further recovery of the power is difficult. Then disconnecting one of the capacitors connected in series, leaving the remaining two capacitors connected in series, enables further recovery of the power from the piezoelectric element as shown in FIG. 7B. The total voltage of the capacitors drops to 2E, which is illustrated to be lower than that of the piezoelectric element. The power remained in the piezoelectric element flows out, enabling the power to be recovered to the capacitors. If the power is further recovered to the point where the voltage of the piezoelectric element and the total voltage of the capacitors become too close for the power to flow, another capacitor may be switched out of the in-series connection to connect the only remaining capacitor as shown in FIG. 7C. Connecting only one capacitor produces the voltage E that is lower than the piezoelectric element, and again enables the remaining power recovered to the capacitor.

When the voltage of the piezoelectric element is high, the power recovery module 204 of the embodiment connects the capacitors in series to bring the total voltage of the capacitors near the voltage of the piezoelectric element. When the voltage of the piezoelectric element falls, the power recovery module 204 removes one of the capacitors connected in series to lower the total voltage of the capacitors. Reducing the difference in voltage between the piezoelectric element and capacitors reduces power loss due to a large current flow, but enables continuing power recovery even when the voltage of the piezoelectric element further lowers.

In addition, the power recovery module of the embodiment changes the total voltage of the capacitors by connecting or disconnecting the capacitors in series, rather than varying voltages of each of the capacitors and switching among them. Neither capacitors of differing voltages or corresponding power sources to charge the capacitors at the differing voltages are necessary, and the device remains simple in its configuration without making the device larger.

The voltage applied to the capacitors of the power recovery module may be adjusted in accordance with the voltage to be applied to the piezoelectric element. For example, ejecting minimum-sized ink droplets requires only a minimum deformation of the piezoelectric element and hence, the voltage required to drive the piezoelectric element is also the minimum level. Because connecting all three capacitors in series produces the total voltage much higher than that of the piezoelectric element, the power recovery module in this example starts with two capacitors connected in series. In such a case, only two levels of voltage are available from the connected capacitors. When the voltage of the piezoelectric element is collected enough for the power recovery module to switch one of the capacitors off of the in-series connection, the difference in the total voltage of the capacitors immediately before and immediately after is large, because there are only few levels of voltage available.

As opposed to starting with only few capacitors connected in series, starting with all three capacitors connected in series and each charged at a lower voltage will enable power recovery at a full three levels of voltage. Using all the capacitors each charged at a lower voltage allows for more available levels of voltage, and the difference in voltage immediately before and after the switch-out is smaller. Even immediately after switching out one of the capacitors connected in series, the difference in the voltages of the piezoelectric element and the capacitors is kept small to be able to suppress the current flow and reduce power consumption to realize efficient power recovery.

The recovered power can be used to raise the voltage of the piezoelectric element again, which saves power and improves the power efficiency. Hereafter, a brief description will be given to represent how the power recovered by the power recovery module is reused.

Figure 8A:
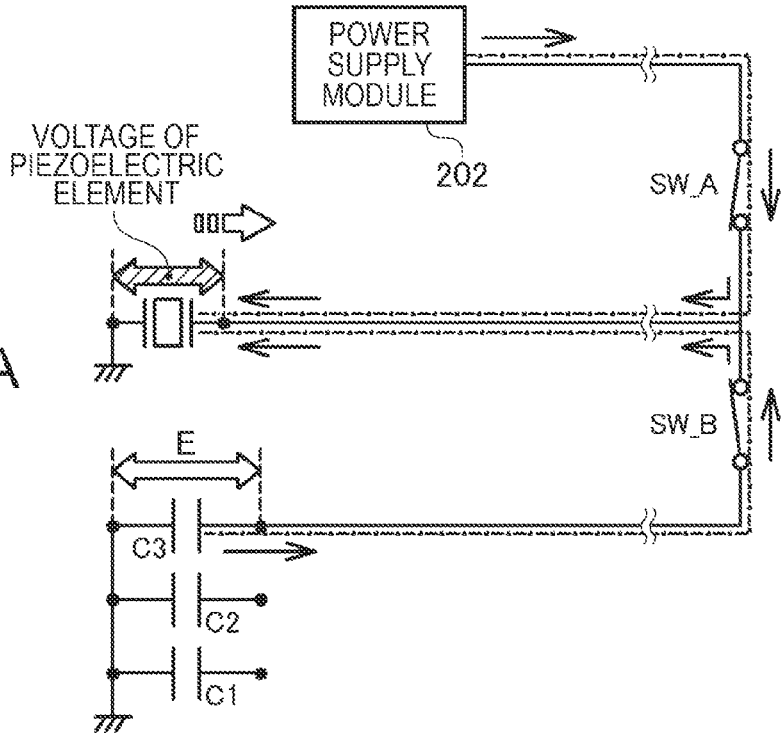
FIGS. 8A and 8B are illustrations showing how the power recovered in the capacitors of the power recovery module is applied to the piezoelectric element.
Figure 8B:
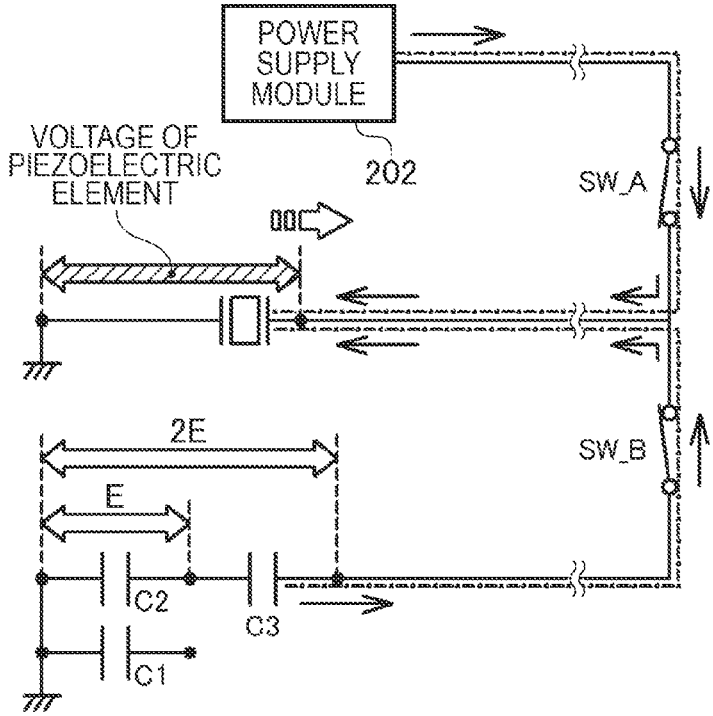

FIGS. 8A and 8B are illustrations showing an aspect of reusing the power recovered in the capacitors of the power recovery module as the voltage of the piezoelectric element is raised. FIG. 8A shows the status immediately after supplying power to the piezoelectric element at a beginning of a rise of the voltage. The power is supplied from the power supply module 202 when raising the voltage of the piezoelectric element in the way previously described. When reusing the recovered power, the capacitors of the power recovery module 204 are also connected to the piezoelectric element in addition to the power supply module 202. At the starting point of providing power to apply to the piezoelectric element, the voltage of the piezoelectric element is lower than the total voltage of the capacitors. The current flows from the capacitors toward the piezoelectric element, as indicated by arrows in the illustration, enabling the power recovered and stored in the capacitors to flow to the piezoelectric element.

Supplying power to the piezoelectric element in this way charges the piezoelectric element to the point where the voltage of the piezoelectric element is so high that the power from the capacitors no longer flows. In that case, as shown in FIG. 8B, connecting the capacitors C2 and C3 in series produces a total voltage of 2E from the sum of the voltage of the capacitors C2 and C3, which is higher than the voltage of the piezoelectric element. Because the total voltage of the capacitors is higher, the power starts to flow again to the piezoelectric element. Similarly, when the voltage of the piezoelectric element rises higher, connecting all the three capacitors C1 to C3 to the piezoelectric element in series will provide the summed voltage of all the capacitors higher than the piezoelectric element and cause the power to flow. Raising the total voltage of the capacitors enables the power to be continuously supplied to the piezoelectric element when the voltage of the piezoelectric element rises even higher. When supplying power from the power recovery module, the capacitors may be connected in series from the beginning, rather than having them connected in series, depending on the voltage of the piezoelectric element. Configuring the capacitors to be connected in series at default enables power supply without having to operate the switches every time the voltage of the piezoelectric element changes. It also saves time for operating the switches to enable the voltage of the piezoelectric element raised swiftly, and hence it enables swift ejection of ink droplets. As opposed to connecting the capacitors in series at default, switching the capacitors to connect in series depending on the voltage of the piezoelectric element as shown in FIGS. 8A and 8B can raise the voltage while keeping the voltage difference between the piezoelectric element and the capacitors small. It can reduce the power consumption caused by the current flowing from the capacitors to the piezoelectric element, and utilize the recovered power more efficiently.

As described above, the piezoelectric element drive circuit 200 of the invention recovers the power supplied to the piezoelectric element to the power recovery module 204, and supplies the recovered power to the piezoelectric element again. The power recovery module 204 recovers the power while the voltage of the capacitors and the voltage of the piezoelectric element are close enough. That suppresses a large current flow that consumes power and efficiently recovers the power. When the voltage of the piezoelectric element falls, a number of capacitors connected in series may be changed so to be able to recover the remaining power in the piezoelectric element as efficiently as possible. The recovered power may be reused for supplying the power back to the piezoelectric element, and hence the ink jet printer 10 of the embodiment is able to print image as it reduces power consumption. The power recovery module of the embodiment requires neither capacitors charged at differing voltages or corresponding power sources to charge the capacitors. Therefore the ink jet printer 10 of the embodiment is able to reduce power consumption without complicated configuration while keeping the printer size down.

D. Piezoelectric Element Drive Circuit of Second Embodiment:

The piezoelectric element drive circuit of the first embodiment has been described to have the power supply module and power recovery module separately, that the power is supplied by the power supply module and the power is recovered by the power recovery module. According to a second embodiment, power may be supplied and recovered by the power recovery module, provided that a power source is made available to the power recovery module.

Figure 9:
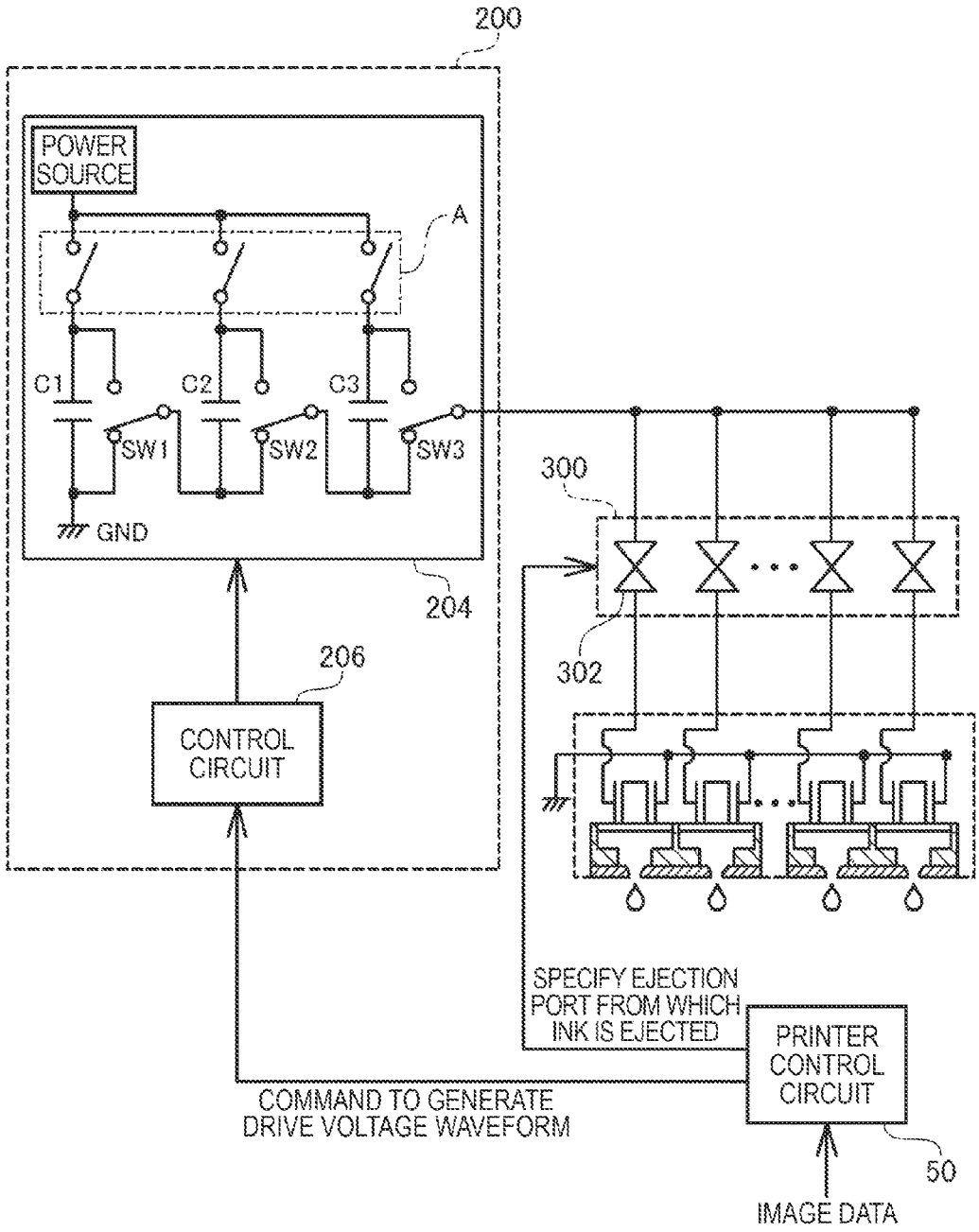
FIG. 9 is an illustration of a piezoelectric element drive circuit of a second embodiment using a power recovery module to supply power.

FIG. 9 is an illustration showing a piezoelectric element drive circuit of a second embodiment, in which power is supplied and recovered by the power recovery module. The piezoelectric element drive circuit of the second embodiment has no power supply but the power recovery module 204. The power recovery module 204 has a power source, which is connectable to each of the capacitors through switches indicated as A in the illustration. The piezoelectric element drive circuit of the second embodiment uses such configuration to apply the voltage waveform as described below. It is assumed that the switches indicated by A in the illustration are turned ON to charge the capacitors immediately before the voltage waveform is applied, and are subsequently turned OFF.

Figure 10A:
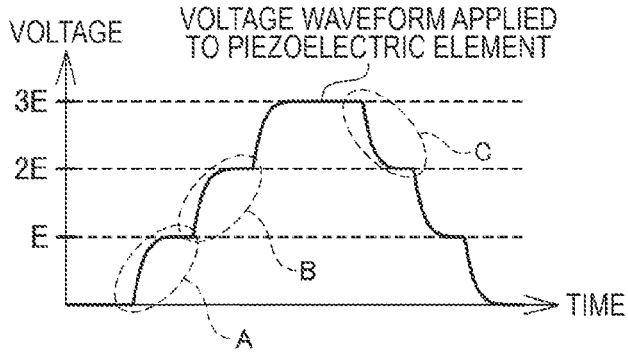
FIGS. 10A to 10D are illustrations showing how the piezoelectric element is driven using the piezoelectric element drive circuit of the second embodiment.
Figure 10B:
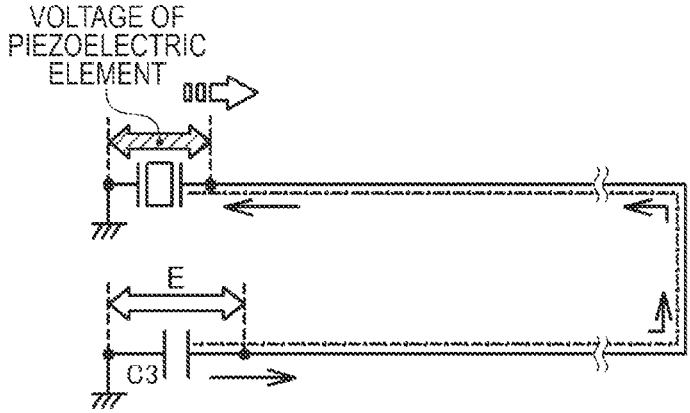
Figure 10C:
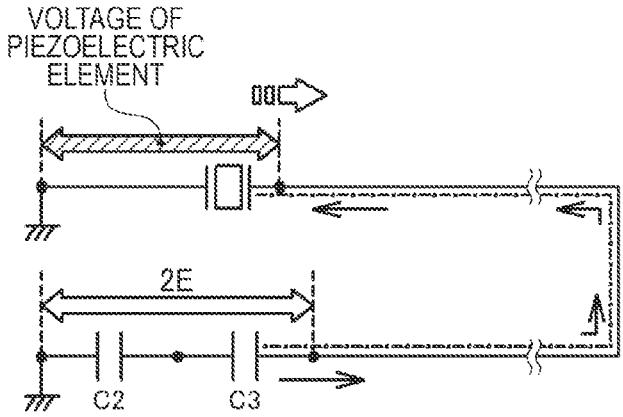

FIGS. 10A to 10D are illustrations showing an aspect of driving the piezoelectric element using the piezoelectric element drive circuit of the second embodiment. The voltage waveform applied to the piezoelectric element is exemplified in FIG. 10A. The voltage waveform is applied to the piezoelectric element by the power recovery module in the following way. As shown in FIG. 10B, the capacitor C3 is connected to the piezoelectric element. Provided that the capacitor C3 is charged in advance to a predetermined voltage (a value indicated as E in the illustration) by the power source of the power recovery module 204, power is supplied from the capacitor C3 to the piezoelectric element, as indicated by arrows in the illustration. The voltage of the piezoelectric element rises from receiving the power and the portion of the waveform A is applied to the piezoelectric element as shown in FIG. 10A. Then the capacitor C3 and capacitor C2 are connected in series (referring to FIG. 10C) in order to raise the voltage further and apply the next portion of the voltage waveform (the portion indicated by B in FIG. 10A). The voltage of the capacitors becomes a sum of the voltage of the capacitor C2 and the voltage of the capacitor C3 (a value indicated as 2E in the illustration). Supplying power to the piezoelectric element, to raise the voltage of the piezoelectric element to 2E enables the portion of the waveform indicated by B in FIG. 10A to be applied. Similarly, connecting the three capacitors in series enables the piezoelectric element to be applied with a voltage waveform that raises the voltage of the piezoelectric element as high as "3E".

Figure 10D:
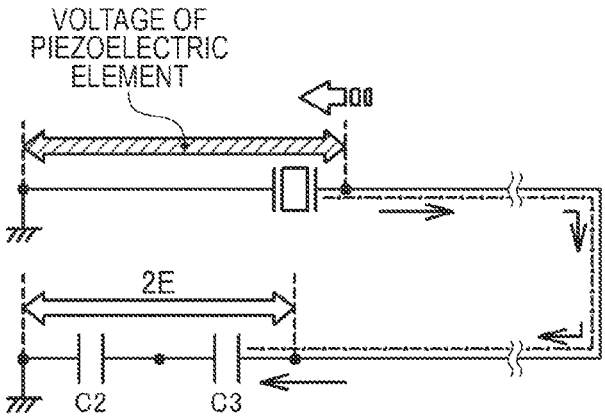

When applying a waveform portion that lowers the voltage of the piezoelectric element, like the portion indicated by "C" in FIG. 10A, the number of capacitors connected in series may be reduced. For example, reducing one capacitor from the three capacitors connected in series to have the remaining two capacitors connected in series, as shown in FIG. 10D, the voltage of the capacitors falls to 2E. When the power flows from the piezoelectric element to the voltage level of 2E, the waveform indicated by C in FIG. 10A is able to be applied. Similarly, by decreasing the number of the capacitors to one, a waveform that lowers the voltage of the piezoelectric element to the voltage level E is made applicable. By switching all the switches SW1 to SW3 off, or changing them over to the lower side as shown in FIG. 9, no capacitor is then connected to the piezoelectric element. The piezoelectric element is earthed directly to ground ("GND") so to be able to apply a waveform that lowers the voltage of the piezoelectric element to as low as the GND level.

In the piezoelectric element drive circuit of the second embodiment, the power recovery module 204, instead of the power supply module provides the power to the piezoelectric element to apply the voltage waveform. Naturally, as there is a limit to the power which can be accumulated in the capacitors, not all the power supplied to the piezoelectric element is recovered. Continuing to supply the power from the capacitors reduces the power stored in the capacitors and eventually causes the voltage of the capacitors to fall. In such case, additional power may be charged in the capacitors by connecting the capacitors to the power source provided in the power recovery module 204 (referring to FIG. 9). The capacitors can maintain the power to be able to continue applying the appropriate voltage waveform, while keeping up the voltage level.

As such, the piezoelectric element drive circuit of the second embodiment includes a power source in the power recovery module 204 so as to be able to drive the piezoelectric element using only the power recovery module. It realized a simplified device configuration without having to include a power supply module.

E: Modified Embodiments:

E-1. First Modified Embodiment:

The power recovery modules of the heretofore described embodiments have been described assuming that the power source and each of the capacitors are connected via the switches (refer to the switches indicated by A in FIG. 9). Connecting via rectifying devices such as diodes instead of the switches may further simplify the power recovery module configuration.

Figure 11:
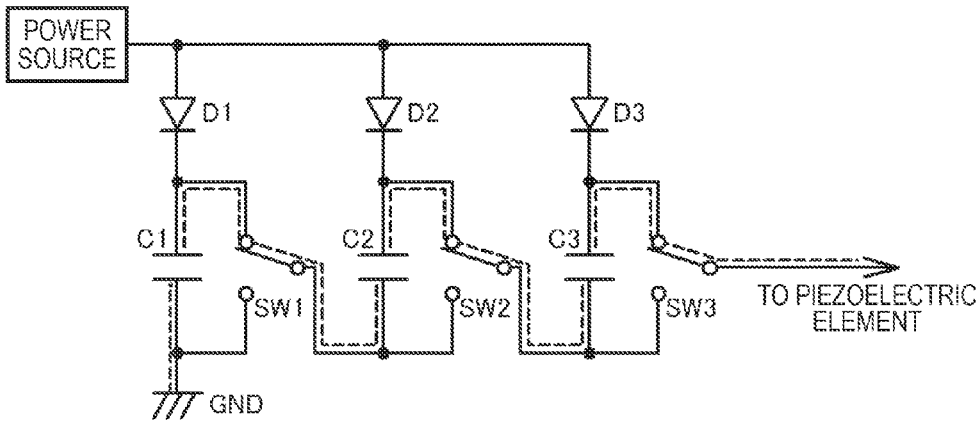
FIG. 11 is an illustration showing a power recovery module of a modified embodiment in which each capacitor and a power source are connected using a diode.

FIG. 11 is an illustration showing a power recovery module of a modified embodiment in which the power source and capacitors are connected with diodes. In the power recovery module of the modified embodiment, the capacitors C1 to C3 are connected to the power source via diodes D1 to D3 respectively. In the case of connecting the capacitors to the power source using diodes in this way, power is supplied from the power source to the capacitors, but no power flows from the capacitors to the power source. In has the same effect as connecting the capacitors and the power source with the switches turned OFF. The power recovered in the capacitors is prevented from flowing out to the power source, enabling the power recovered to be efficiently reused without being consumed. Also, additional power is immediately supplied from the source via the diodes when the power in the capacitors is insufficient and hence the power level in the capacitors is maintained.

As shown in the illustration, the diodes are provided at terminals of the capacitors C1 to C3 on the upper side to prevent current from flowing among those upper terminals of the capacitors. This enables an in-series connection of the capacitors to raise the voltage. For example in the illustration, the electric potential at the upper terminal of the capacitor C3 is higher than that at the upper terminals of the capacitor C2 and capacitor C1, but as the current is blocked by the diodes, the current from the upper terminal of the capacitor C3 does not flow to the upper terminals of the capacitor C1 and capacitor C2, preventing the voltage of the capacitor C3 from falling. Hence it is possible to supply power to the piezoelectric element from the capacitors connected in series, or to recover the power of the piezoelectric element. The power recovery module 204 of the modified embodiment is able to provide power to or recover power from the piezoelectric element, in the same way as connecting the capacitors and the power source with switches turned OFF. This way the power recovery module 204 can operate without having to switching ON or OFF between the power source and the capacitors and simplify the control circuit 206 while keeping the size of the device down.

E-2. Second Modified Embodiment:

The first modified embodiment has been described to have the capacitors disconnected from each other when not connected in series (refer to FIG. 6C). The capacitors that are not connected in series may be connected in parallel, instead of being completely disconnected.

Figure 12A:
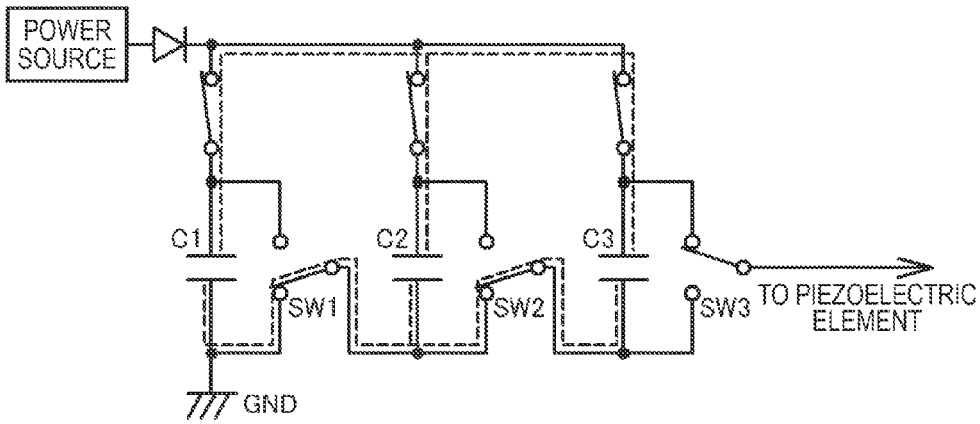
FIGS. 12A and 12B are illustrations showing a power recovery module of a modified embodiment in which each capacitor of the power recovery module is connected in parallel.
Figure 12B:
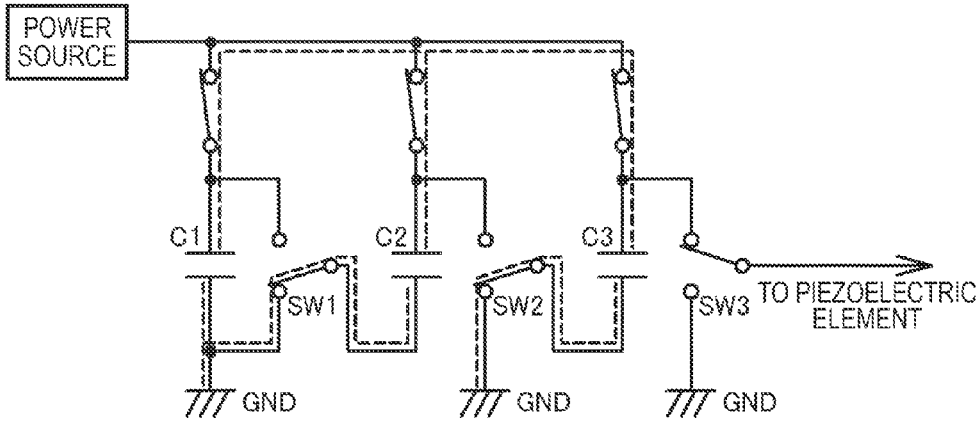

FIGS. 12A and 12B are illustrations showing a condition in which each capacitor is connected in parallel. In FIG. 12A, the upper terminals of each capacitor are connected to each other via switches. Also, the lower terminals of each capacitor are also connected to each other via switches SW1 and SW2. By connecting each capacitor in parallel in this way, power is shared among the capacitors to be able to distribute the power recovered from the piezoelectric element evenly among the capacitors. By this means, it is possible to avoid a situation in which the power is concentrated in a single capacitor which may eventually lead to shortening the life span of that capacitor. When the voltage of one of the capacitors changes from supplying or recovering of the power, exchanging or sharing the power with other capacitors reduces the difference in the voltage between the capacitor and the other capacitors. This way the voltage applied to the piezoelectric element does not vary too much from one capacitor to another. The modified embodiment is preferable in such a way that the voltage of the capacitors is stabilized and does not vary too much from one another, contributing to recovering the power of the piezoelectric element efficiently.

When connecting the capacitors in parallel, diodes may be used to connect between the power source and the switches, as shown in FIG. 12A. Having the diodes rectifies the power flow to prevent from flowing from the capacitors to the power source and hence it is possible to supply the power stored in the capacitors to the piezoelectric element efficiently. The switch SW2 may be earthed directly to the ground GND, as shown in FIG. 12B. Although elements such as FET may be employed as the switch in the power recovery module, such elements may cause a slight difference in the voltage between before and after the switch due to an internal resistance of the element. When the capacitors are connected using a plurality of such switches, the differences caused in the switches may build up to cause large differences in voltage among each of the capacitors. For example, as the lower terminal of the capacitor C1 and lower terminal of the capacitor C3 are connected via two switches SW1 and SW2 (refer to FIG. 12A), the difference in voltage between the capacitor C1 and capacitor C3 may build up. Earthing the switch SW2 directly to the ground to connect the capacitor C1 and capacitor C3 via the ground without having to use the switch SW1 can suppress the difference in voltage between the capacitors.

Connecting the capacitors in parallel may be done at a predetermined timing, instead of every time the capacitors are disconnected from the in-series connection. For example, using a counter and a predetermined threshold, the power recovery module may count the number of times the piezoelectric element has ejected ink droplets. When the counter reaches the threshold, the capacitors are connected in parallel. This has an advantage in that the power variances among the capacitors can be reset when the variances are growing large from ongoing operation of the piezoelectric element ejecting ink droplets. This way the piezoelectric element is driven more swiftly to enable more quicker printing, because no time is required for switching the capacitors back to the in-parallel connection while the accumulated variances among the capacitors are still small.

Heretofore, a description has been given of the fluid ejection device of the embodiments but, the invention not being limited to all of the heretofore described embodiments, it can be implemented in various forms without departing from the scope thereof. For example, the invention may be applied to various printing apparatuses having a larger ejection head (a so-called line head printer, or the like). The printer with a larger ejection head requires a large number of piezoelectric elements depending on the size of the ejection head, and hence often consumes more power. Applying the invention enables to reduce power consumption by efficiently recovering the power. Even with a larger ejection head, the size of the printer is kept compact because multiple power sources are not necessary so to keep the circuit configuration simple and compact.

Also, in the heretofore described embodiments, a description has been focusing on driving piezoelectric elements of an ink jet printer as an example, but the drive circuits described in the embodiments can be applied to various devices which drive elements that are capable of storing power. For example, in liquid crystal panels, power is held by an electrical field generated inside the liquid crystal. Application of the drive circuits of the embodiments to such device enables efficient power recovery and saves energy. Of course, multiple power sources are not necessary in this case either. Applying this invention to such device keeps the configuration of the device simple and compact.

What is claimed is:

1. A fluid ejection device comprising:

a drive element capable of storing or releasing a charge depending on a voltage applied to the drive element;

a first capacitor;

a second capacitor; and a power recovery module that recovers a charge from the drive element by connecting the first capacitor and the second capacitor in series to the drive element, wherein the power recovery module switches the first capacitor out of in-series connection to further recover the charge from the drive element.

2. The fluid ejection device according to claim 1, wherein the power recovery module switches the first capacitor out by connecting the first capacitor and the second capacitor in parallel to the drive element.

3. A fluid ejection device comprising:

a drive element capable of storing or releasing a charge depending on a voltage applied to the drive element;

a first capacitor;

a second capacitor;

a power source that charges the first capacitor and the second capacitor;

a power recovery module that charges the drive element by connecting the first capacitor to the drive element, wherein the power recovery module connects the second capacitor in series with the first capacitor to the drive element to further charge the drive element.

4. The fluid ejection device according to claim 3, wherein the power recovery module charges the drive element by connecting the first capacitor and the second capacitor in parallel to the drive element.

5. The fluid ejection device, comprising:

a drive element capable of storing or releasing a charge depending on a voltage applied to the drive element;

a first capacitor;

a second capacitor;

a power source that charges the first capacitor and the second capacitor;

a power recovery module that charges the drive element or recovers a charge from the drive element by connecting the first capacitor and the second capacitor to the drive element, wherein the power recovery module charges the drive element or recovers the charge from the drive element by switching the connections of the first capacitor and the second capacitor in series or in parallel.

* * * * *